US007128097B2

(12) United States Patent
Axelsson et al.

(10) Patent No.: US 7,128,097 B2
(45) Date of Patent: Oct. 31, 2006

(54) TRANSPARENT SEAM SPIRALS

(75) Inventors: Stefan Axelsson, Aled (SE); Lars Jansson, Gullbrandstorp (SE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/979,959

(22) Filed: Nov. 3, 2004

(65) Prior Publication Data

US 2005/0145289 A1 Jul. 7, 2005

Related U.S. Application Data

(60) Provisional application No. 60/518,917, filed on Nov. 10, 2003.

(51) Int. Cl.
*D21F 7/10* (2006.01)
*D21F 1/12* (2006.01)

(52) U.S. Cl. ..... 139/383 AA; 139/383 A

(58) Field of Classification Search ..... 139/383 A, 139/383 AA
See application file for complete search history.

(56) References Cited

U.S. PATENT DOCUMENTS 4,476,902 A * 10/1984 Westhead ..... 139/383 AA
4,567,077 A 1/1986 Gauthier
4,574,435 A * 3/1986 Luciano et al. ..... 24/33 C
4,896,702 A * 1/1990 Crook ..... 139/383 A
4,938,269 A 7/1990 Nicholas et al.
5,732,749 A * 3/1998 Fargeout ..... 139/383 AA
5,746,257 A * 5/1998 Fry ..... 139/383 AA
5,875,822 A * 3/1999 Fargeout ..... 139/383 AA
5,915,422 A 6/1999 Fagerholm
6,001,443 A 12/1999 Holden et al.
6,302,155 B1 * 10/2001 Rydin ..... 139/383 AA

FOREIGN PATENT DOCUMENTS

GB 2 316 354 A 2/1998

OTHER PUBLICATIONS

American Plastics Council, Hands on Plastics, 2005, entire document.*
QEHS Design and Technology, Polymer FAQ, p. 4.*

* cited by examiner

*Primary Examiner*—Gary L. Welch
*Assistant Examiner*—Robert Muromoto
(74) *Attorney, Agent, or Firm*—Frommer Lawrence & Haug LLP; Ronald R. Santucci

(57) ABSTRACT

The present invention relates to a seam for use in joining a first end and a second end of a papermakers' fabric. The seam may include a first seaming spiral element attachable to the first end and a second seaming spiral element attachable to the second end. At least one of the first or second spiral seaming elements is transparent.

6 Claims, 3 Drawing Sheets

TRANSPARENT SEAM SPIRALS

CROSS-REFERENCE TO RELATED APPLICATIONS

This application is based upon and claims the benefit of U.S. Provisional Patent Application Ser. No. 60/518,917 filed Nov. 10, 2003 entitled "TRANSPARENT SEAM SPIRALS", the disclosure of which is incorporated herein by reference.

BACKGROUND OF THE INVENTION

1. Field of the Invention

The present invention relates to the papermaking arts. More specifically, the present invention relates to seamed fabrics for use with a paper machine. The invention is especially applicable to the production of seams on dryer fabrics, but also may be used for forming fabrics, press fabrics and other industrial fabrics/belts that utilize a spiral seam.

2. Description of the Related Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam. Woven fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers. Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. Because of the solid support beams for dryer sections, all dryer fabrics must have a seam. Installation of the fabric includes pulling the fabric body onto a machine and joining the fabric ends to form an endless belt.

The seam region of any workable fabric must behave in use as close to the body of the fabric in order to prevent the periodic marking by the seam region of the paper product being manufactured.

To facilitate seaming, many current fabrics have seaming loops on the crosswise edges of the two ends of the fabric. The seaming loops themselves are formed by the machine-direction (MD) yarns of the fabric. A seam is formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Alternatively, a monofilament seaming spiral may be attached to the seaming loops at each of the two ends of the papermaker's fabric. The monofilament seaming spirals are connected to the seaming loops by at least one connecting yarn. The coils of the spirals at the two ends of the fabric may again then be interdigitated and joined to one another on the paper machine to form a seam usually referred to as a spiral seam.

In a so-called warp loop seam, the rows of loops are formed of extended edge loops of warp yarns in the fabric structure of the fabric. In a spiral seam, each row of loops is instead formed of a separate, preformed yarn spiral, which is extended along and attached by means of a CD pintle connecting the spiral, intermeshed with the machine direction yarns, such as warp yarns, to the seam edge of the fabric. The coils of the spirals at the two ends of the fabric may again then be interdigitated and joined to one another on the paper machine to form a seam usually referred to as a spiral seam. Alternatively, the spiral can be attached to the clothing by a number of cross-machine direction yarns being raveled a distance from the seam edge, whereupon the loops of the spiral are inserted into the thus formed looser edge portion. Then the edge is folded back over itself and is attached to the clothing, for instance, by using a sewing machine. Independently of how the spiral is attached, the clothing comprises two spirals, one along each seam edge, which, when joining together the fabric, are meshed with each other like a zipper so as to be joined together by means of a pintle wire or the like.

Alternatively, fabrics can be formed completely of spirals as taught by Gauthier, U.S. Pat. No. 4,567,077; which is incorporated herein by reference. In this case, the spirals are connected to each other by at least one connecting pin. In theory, the seam can therefore be at any location in the fabric body where a connecting pin may be removed. The best known advantage of a spiral fabric versus a woven fabric is the seam is geometrically similar to the fabric body.

A seam is generally a critical part of a seamed fabric, since uniform paper quality, low marking and excellent runnability of the fabric are required.

An important aspect of seaming a fabric on a paper machine is the necessity of threading a leader wire, pin or pintle through the fabric loops or spirals on the opposed ends of the fabric. The ends of the fabric must be brought together on the machine, and a flexible leader wire is threaded through the loops or spirals. Preferably, the leader wire can be threaded across in one operation. Frequently, however, only a short section or length is done at a time. Then it is used to pull the pintle through while pulling the leader out of a gap between loops. This is repeated across the width of the machine, which may exceed 400 inches. This process is made difficult because the leader wire or pintle tends to pop out or migrate out of the loops. When this migration occurs the leader wire or pintle must be removed and the threading process restarted, thus increasing the time to seam the fabric. Also, since the seaming spirals are opaque, it is impossible to visually follow the progressing leader wire through the seam.

Therefore, during a seaming operation, a need exists to reduce migration of the leader wire or pintle and to facilitate the insertion thereof. The present invention provides a solution to this problem.

SUMMARY OF THE INVENTION

The present invention relates to a seam having at least one transparent spiral seaming element for use in a papermaker's fabric or the like. Such a transparent spiral seaming element allows easy and quick installation of a leader wire or a pintle through the path formed from the interdigiated spiral seaming elements.

In accordance with a first aspect of the present invention, seam elements for use in joining a first end and a second end of a paper makers' fabric are provided. Such seam may include a first seaming spiral element couplable to the first end and a second seaming spiral element couplable to the second end wherein at least one of the first or second spiral seaming elements is transparent.

The present invention will now be described in more complete detail with frequent reference being made to the figures wherein like reference numerals denote like elements and parts, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

At least part of the reason why it is so difficult to insert a leader wire or a pintle through the spirals on the ends of a fabric is due to the difficulty in seeing the leader wire or pintle during the insertion or seaming operation. That is, during seaming, the interdigiated spirals do not allow a technician seaming the fabric to see the leader wire or the pintle as it is inserted in the gap defined by opposed spirals. One embodiment of the present invention provides that at least one of the spiral seaming elements or loops for joining a first end and a second end of a papermaker's fabric is transparent. It should be understood that the term transparent is meant to encompass seaming elements that to some degree allow the user to see the pintle passing therethrough. Thus, they may be clear, opaque, somewhat opaque, translucent, or sufficiently translucent so as to allow diffusible light to pass therethrough. As such it enables the technician performing the seaming operation to see the leader wire or pintle as it is being inserted through the gap defined by the opposed spiral seaming elements, thereby allowing the leader wire or pintle to be easily inserted through such gap.

The present invention may be applicable to any type of papermaking fabric including woven, non-woven, spiral formed, single and multi-layered and so forth which is seamed to form an endless fabric. Such fabrics may be seamed on a paper machine. Furthermore, the present invention may be particularly advantageous for a dryer fabric usable in the dryer section of the papermaking system.

A preferred embodiment of the present invention will now be described.

Figure 1:
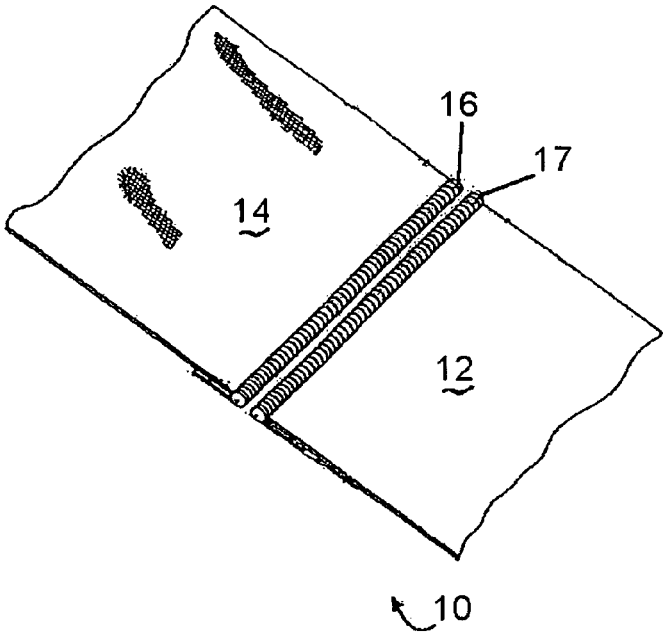
FIG. 1 is a perspective view of a fabric having a first end and a second end which are not joined together.
Figure 2:
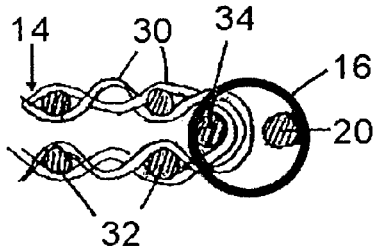
FIG. 2 is an enlarged, cross-sectional view along lines 2—2 depicted in FIG. 3.

FIG. 1 is a perspective view of a fabric 10 which may have been loaded onto a papermaking machine and is ready for seaming. At this point, the fabric has a first end 14 having a first spiral seaming element 16 which has been coupled or attached to an edge thereof and a second end 12 having a second spiral seaming element 17 which has been coupled or attached to an edge thereof. To secure the first spiral seaming element 16 to the first end 14, a connecting pin or pintle 34 or the like is inserted through a passage or channel defined by spiral element 16 and yarns 30 on the fabric body as shown in FIG. 2 (which is a view along lines 2—2 of FIG. 3). The second spiral seaming element 17 may be secured to the second end 12 in a similar manner. As is to appreciated, other methods of attaching seaming elements 16 and 17 to first end 14 and second end 16 may also be used, for example, weaving, sewing or the like. Such other methods would be readily apparent to one skilled in the art.

Figure 3:
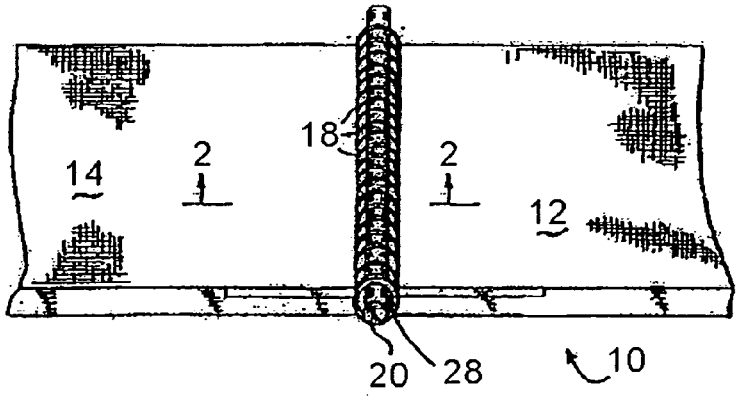
FIG. 3 is a perspective view of the fabric of FIG. 1 in which the first end and the second end are joined to one another by a seaming pintle.

As shown in FIG. 3, first spiral seaming element 16 and second spiral seaming element 17 may be interdigitated with one another to define a passage or a pintle receiving channel 28. A pintle 20 may be inserted through the pintle receiving channel 28 so as to join the first end 14 and the second end 12 together. Pintle 20 may be a monofilament cable of a synthetic polymeric resin. The pintle 20 may be removed from and re-inserted into pintle receiving channel 28 so that the seam may be opened and closed as desired.

The fabric 10 may have at least one layer of interwoven warp yarns 30 and weft yarns 32, such as shown in FIG. 2. The yarns 30 and 32 may be round in cross section or non-round such as "flat" or rectangular monofilaments of a synthetic polymeric resin such as a polyamide, polyolefin or a polyester material. Further, fabric 10 may also include additional layers. For example, a batting layer (not shown) may be needled into at least one layer.

Each of the first spiral seaming element 16 and the second spiral seaming element 17 may be a spiral structure made of a continuous length of monofilament of a synthetic polymeric resin. First spiral seaming element 16 may have a left or a right hand spiraling and the second spiral seaming element 17 may have the opposite one of the left or a right hand spiraling. The dimensions of the spiral seaming elements may be determined in accordance with the parameters of the fabric 10.

In one embodiment of the present invention, at least one of first spiral seaming element 16 and second spiral seaming element 17 is transparent. Spiral seaming element may also be formed from a round or other shape monofilament. Furthermore, they may have a particular shape such as taught in U.S. Pat. No. 5,915,422.

Figure 4:
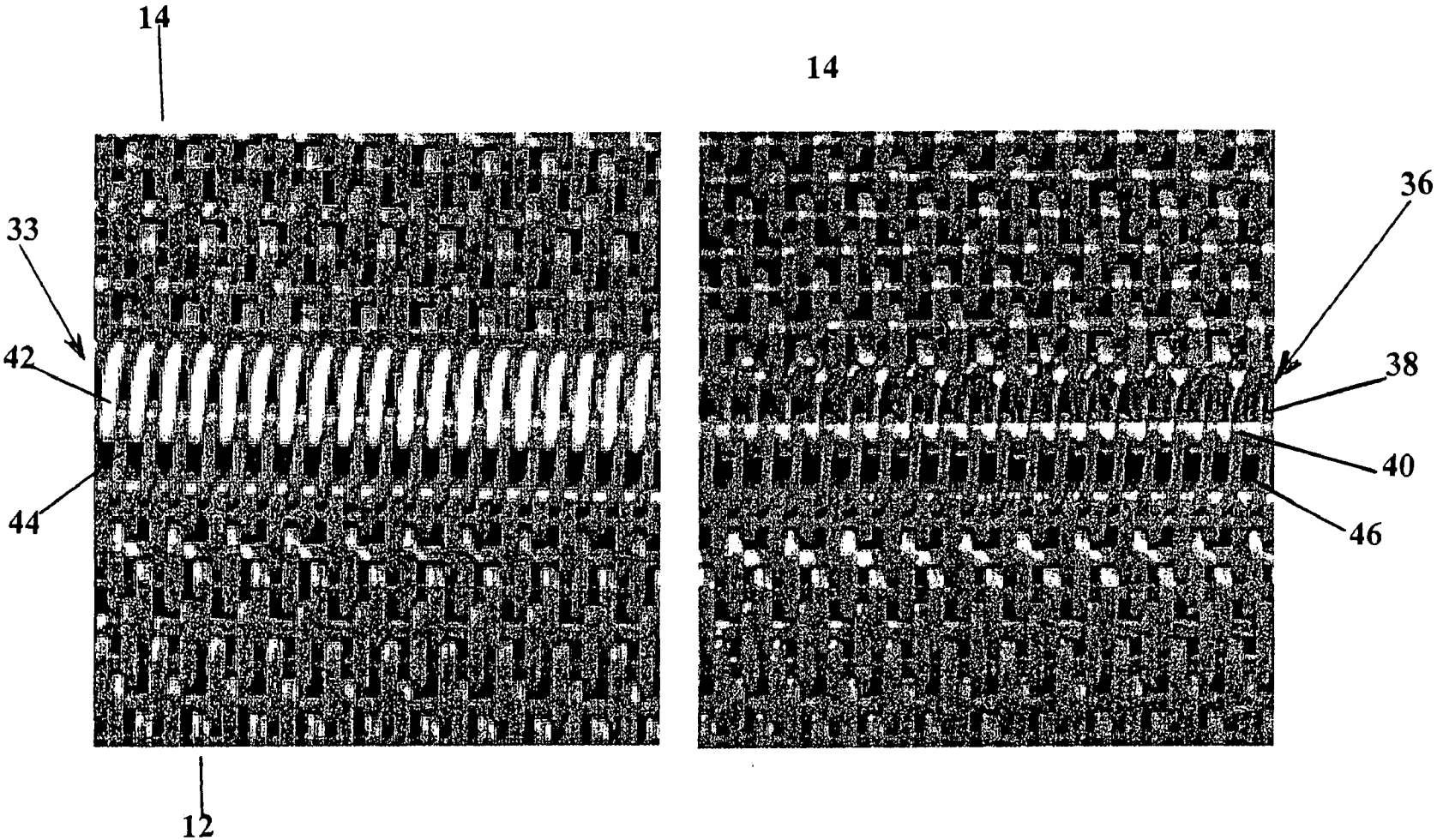
FIG. 4 is a side-by-side comparison of a fabric having an in-line double density spiral ("IDDS") seam without any transparent seaming elements and an IDDS seam in accordance with an embodiment of the present invention.

FIG. 4 is a side-by-side comparison of an in-line double density spiral ("IDDS") seam 33 in which neither of the seaming elements is transparent and an IDDS seam 36 in which one of the spiral seaming elements is transparent. More specifically, IDDS seam 33 has a non-transparent first spiral seaming element 42, a second non-transparent spiral seaming element 44, and a pintle inserted in a pintle receiving channel formed by interdigitating the first spiral seaming element 42 and second spiral seaming element 44. As is to be appreciated, since neither of the first spiral seaming element 42 and second spiral seaming element 44 is transparent, the pintle inserted therein is not visible from the top or bottom of the fabric. Accordingly, the non-transparent first and second spiral seaming elements 42 and 44 prevent a technician from seeing the pintle as it is inserted in the channel. In sharp contrast, IDDS seam 36 includes a first spiral seaming element 38 which is transparent, a second spiral seaming element 46 which is not transparent, and a pintle 40 inserted in a pintle receiving channel formed by interdigitating the first spiral seaming element 38 and second spiral seaming element 46. Since the first spiral seaming element 38 is transparent, the pintle 40 is visible therethrough from the top of the fabric. Accordingly, a technician seaming the fabric can readily see the leader wire or pintle 40 during a seaming operation. As a result, the time required to perform such operation should be reduced as compared to the time required to perform a similar operation for seam 33.

Figure 5:
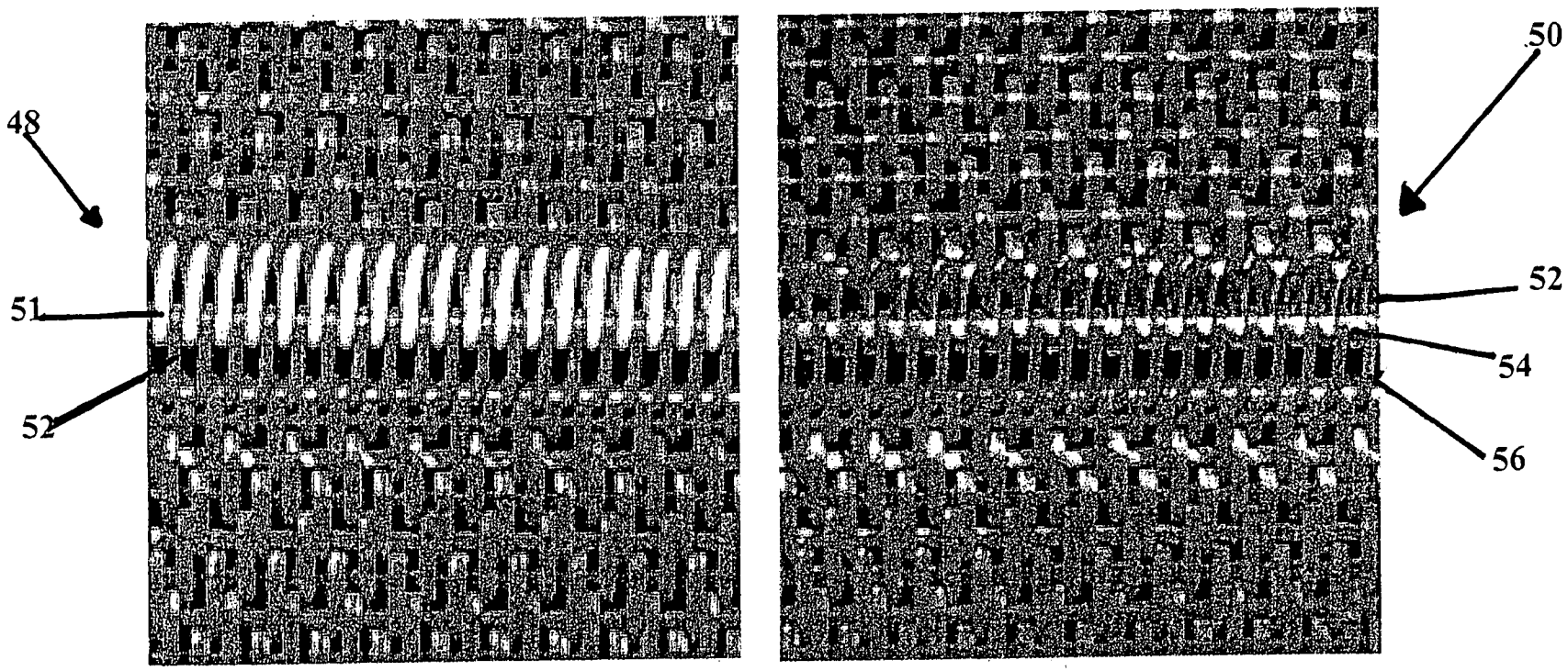
FIG. 5 is a side-by-side comparison of a fabric having a finer IDDS seam without any transparent seaming elements and a finer IDDS seam in accordance with an embodiment of the present invention.

FIG. 5 is a side-by-side comparison of a finer IDDS seam 48 in which neither of the seaming elements is transparent and a finer IDDS seam 50 in which one of the spiral seaming elements is transparent. In a manner similar to that described above with regard to FIG. 4, IDDS seam 48 has a non-transparent first spiral seaming element 51, a second non-transparent spiral seaming element 53, and a pintle inserted in a pintle receiving channel formed by interdigitating the first spiral seaming element 51 and second spiral seaming element 53. Since neither of the first spiral seaming element 51 and second spiral seaming element 53 is transparent, the pintle inserted therein is not visible from the top or bottom of the fabric. Accordingly, the non-transparent first and second spiral seaming elements 51 and 53 prevent a technician from seeing the pintle as it is inserted in the channel. On the other hand, IDDS seam 50 includes a first spiral seaming element 52 which is transparent, a second spiral seaming element 56 which is not transparent, and a pintle 54 inserted in a pintle receiving channel formed by interdigitating the first spiral seaming element 52 and second spiral seaming element 56. Since the first spiral seaming element 52 is transparent, the pintle 54 is visible therethrough from the top of the fabric. Accordingly, a technician seaming the fabric can readily see the leader wire or pintle 54 during a seaming operation. As a result, the time required to perform such operation should be reduced as compared to the time required to perform a similar operation for seam 48.

Therefore, the use of a transparent spiral seaming element facilitates the installation of a leader wire or a pintle through the pintle receiving channel.

Although in the above described seams 36 and 50 only one of the spiral seaming elements is transparent, the present invention is not so limited. Alternatively, both of the spiral seaming elements may be transparent.

Additionally, although the present invention has been described as having two spiral seaming elements, the present invention is not so limited. Alternatively, the present invention may utilize other numbers of spiral seaming elements such as only one or even no spiral seaming elements. In this later situation, transparent loops such as seaming loops formed from transparent yarns (MD or CD yarns) may be used. That is, a seam may be formed by bringing the two ends of the fabric together, interdigitating the seaming loops formed from the yarns (such as the MD yarns) at the two ends, and directing a pintle through the passage defined by the interdigitated seaming loops to lock the two ends of the fabric together.

Further embodiments of the present invention also include the use of seaming elements which are not completely transparent as aforesaid, but rather retain some level of translucence. That is, the seaming elements are not completely clear but can be milky or more opaque than clear. As a result these seaming elements allow some light to pass there through, but not as much as a clear or transparent seaming element. The exact translucence of the seaming elements is not critical to the use of the invention, rather, the seaming element need only permit sufficient light to pass through so that the pintle may be seen by the technician when seaming the fabric.

In yet a further embodiment considered within the scope of the present invention, the seaming elements need only be sufficiently translucent to allow a sensing light such as an infra-red light to pass there through and enable a technician to ascertain the position of a pintle as it is inserted into the seaming elements. Other sensing light spectra other than infra-red may also be used without departing from the scope of the present invention.

Modifications to the above would be obvious to those of ordinary skill in the art, but would not bring the invention so modified beyond the scope of the present invention.

What is claimed is:

1. Seam elements for use in joining a first end and a second end of a papermakers' fabric, said seam elements comprising:

a first spiral seaming element coupled to said first end; and a second spiral seaming element coupled to said second end, wherein at least one of said first and said second spiral seaming elements is transparent, and a pintle, wherein said pintle is clearly visible within the transparent seaming element.

2. A papermaker's fabric comprising:

a plurality of yarns arranged to form at least one layer, said at least one layer having a first end and a second end;

a first spiral seaming element coupled to said first end; and a second spiral seaming element coupled to said second end, wherein at least one of said first and said second spiral seaming elements is transparent, and a pintle, wherein said pintle is clearly visible within the transparent seaming element.

3. The papermaker's fabric according to claim 2, wherein said first and second spiral seaming elements are interdigitated to form a channel and said pintle is inserted through said channel so as to join said first end and said second end together such that said papermakers' fabric has an endless form.

4. The papermaker's fabric according to claim 2, wherein both of said first and said second spiral seaming elements are transparent.

5. The seam elements of claim 1, wherein at least one of said first and said second spiral seaming elements is clear, opaque, somewhat opaque, translucent or sufficiently translucent so as to allow diffusible light to pass therethrough.

6. The papermaker's fabric according to claim 2, wherein at least one of said first and said second spiral seaming elements is clear, opaque, somewhat opaque, translucent or sufficiently translucent so as to allow diffusible light to pass therethrough.

* * * * *